US007322295B1

(12) United States Patent
Haeselich

(10) Patent No.: US 7,322,295 B1
(45) Date of Patent: Jan. 29, 2008

(54) CARTRIDGE MUNITION, PARTICULARLY ONE OF MEDIUM CALIBER

(75) Inventor: Detlef Haeselich, Muessen (DE)

(73) Assignee: Nico-Pyrotechnik Hanns-Juergen Diederichs & Co, KG, Trittau (DE)

( * ) Notice: Subject to any disclaimer, the term of this patent is extended or adjusted under 35 U.S.C. 154(b) by 0 days.

(21) Appl. No.: 11/517,907

(22) Filed: Sep. 7, 2006

Related U.S. Application Data

(62) Division of application No. 10/897,937, filed on Jul. 23, 2004, now Pat. No. 7,107,909.

(30) Foreign Application Priority Data

Apr. 8, 2004 (DE) ..... 10 2004 017 465

(51) Int. Cl.
*F42B 39/20* (2006.01)
*F42B 5/28* (2006.01)
*F42B 5/02* (2006.01)

(52) U.S. Cl. ..... 102/470; 102/481; 102/439

(58) Field of Classification Search ..... 102/469, 102/470, 471, 472, 464, 438, 441, 430, 440, 102/481, 439
See application file for complete search history.

(56) References Cited

U.S. PATENT DOCUMENTS

| | | | | |
|---|---|---|---|---|
| 2,514,422 | A * | 7/1950 | Simpson | 102/470 |
| 3,665,857 | A * | 5/1972 | Radnich et al. | 102/481 |
| 3,786,761 | A * | 1/1974 | Ciccone et al. | 102/471 |
| 3,927,791 | A * | 12/1975 | Hershberger | 220/89.4 |
| 4,084,512 | A * | 4/1978 | San Miguel | 102/531 |
| 4,892,038 | A | 1/1990 | Lubbers | |
| 5,035,182 | A * | 7/1991 | Purcell et al. | 102/481 |
| 5,038,686 | A * | 8/1991 | Zulkoski et al. | 102/496 |
| 5,786,544 | A * | 7/1998 | Gill et al. | 102/481 |
| 5,936,189 | A | 8/1999 | Lubbers | |
| 5,939,662 | A * | 8/1999 | Bootes et al. | 102/473 |
| 6,338,242 | B1 * | 1/2002 | Kim et al. | 60/204 |
| 6,502,514 | B1 * | 1/2003 | Holler | 102/470 |
| 6,523,477 | B1 * | 2/2003 | Brooks et al. | 102/481 |
| 6,615,737 | B2 * | 9/2003 | Bonnel et al. | 102/481 |
| 6,952,995 | B2 * | 10/2005 | Friedlander, III | 102/481 |

FOREIGN PATENT DOCUMENTS

| | | | |
|---|---|---|---|
| FR | 2627272 | A1 * | 8/1989 |
| FR | 2686410 | A1 * | 7/1993 |

* cited by examiner

*Primary Examiner*—James S Bergin
(74) *Attorney, Agent, or Firm*—Milde & Hoffber, LLP

(57) ABSTRACT

A cartridge munition, as disclosed in U.S. Pat. No. 7,107,909, includes a cartridge shell (3) and a projectile (2) inserted into it. A propulsion chamber (4) is provided within the cartridge shell that receives a propulsive charge (5) that may be ignited by means of a pyrotechnic igniter (13) and that develops propulsive gases that act on the base (8) of the projectile, driving it out of the cartridge shell. In order to prevent the pyrotechnic igniter from igniting spontaneously, and from igniting the propulsive charge (5) because of the ambient temperature or because of a fire, which would cause the cartridge shell and projectile to be separated and fly apart, it is proposed by the invention to provide exhaust channels (14) between the propulsion chamber and the exterior of the cartridge shell (3) that are filled with a fusible material, particularly a fusible metal (15). The fusible material has a lower melting point than the ignition point of the igniter (13) and of the propulsive charge (5). If the ambient temperature of the cartridge shell rises above the melting point of the fusible material, it melts, releasing the exhaust channels (14).

6 Claims, 2 Drawing Sheets

CARTRIDGE MUNITION, PARTICULARLY ONE OF MEDIUM CALIBER

This application is a divisional application of U.S. patent application Ser. No. 10/897,937, filed Jul. 23, 2004, now U.S. Pat. No. 7,107,909.

BACKGROUND OF THE INVENTION

The invention relates to a cartridge munition, particularly to one of medium caliber, and here particularly to a practice round, with a cartridge shell and a projectile inserted into it, and with the cartridge shell mechanically attached to the projectile. A propulsion chamber is provided at the base of the cartridge shell to receive a propulsive charge that, for example, may be ignited using an igniter cap. After ignition, the propulsive gases from the propulsive charge act on the base of the projectile so that, after release of the mechanical bond between cartridge shell and projectile, the projectile is driven out of the cartridge shell.

Such a cartridge munition is described in the U.S. Pat. No. 5,936,189. This cartridge munition is used with rapid-fire weapons of medium caliber (about 40 mm). Many such cartridges are received into a belt that is fed to the rapid-fire weapon. The propulsion chamber in the cartridge shell is sub-divided into a high-pressure chamber into which the propulsive charge is placed and a low-pressure chamber that is connected with the high-pressure chamber via exhaust apertures. Cartridge shell and projectile are mechanically connected via a central threaded connection that is formed as an intended-break point.

When the propulsive charge is ignited pyrotechnically in the high-pressure chamber by means of an igniter cap, the propulsive charge burns and propulsive gases are created at high pressure that then act on the projectile base in both chambers, eventually driving the projectile out of the cartridge shell, after the intended-break point between cartridge shell and projectile is broken.

A similar cartridge munition is described in the U.S. Pat. No. 4,892,038.

Furthermore, practice rounds of this type are known in which only a low-pressure propulsion chamber is provided; such cartridges are known as low-velocity cartridges (Low Velocity Ammunition).

Such cartridge munitions are used in large quantities, and must both be safely stored and safely transported from the manufacturer to the user. Storage and transport are generally performed using larger cases, e.g., metal cases that hold a large quantity of such cartridges.

In spite of the considerable quantity of igniter material for igniter caps and propulsive charge located within a storage or transport container, storage and transport are generally simple. However, a fire in the storage or transport system during which temperatures reach and exceed 220° C. presents a risk.

At such temperatures, the pyrotechnic igniter charge of the igniter cap combusts spontaneously, igniting in turn the propulsive charge that otherwise would have ignited at a temperature from 320° C. to 400° C. After the propulsive charge ignites, as during regular firing, enough pressure develops in the propulsion chamber to act on the base of the projectile eventually to rupture the mechanical connection between cartridge shell and projectile, causing them to fly apart explosively.

Significant damage may result simply from the quantity of exploded propulsive charges of a large number of cartridges. However, the cartridge shell and projectile may cause great damage while flying apart. Cartridge shell and projectile here act quasi as projectiles. Any receiver containers involved will be destroyed, whereby the separated cartridge shells and projectiles may endanger humans and cause major mechanical damage.

During testing, such cartridges are placed into a heater, and heat is gradually supplied to the heater. After the igniter-cap ignition temperature of about 220° C. is reached, as illustrated, the igniter cap and thereby the propulsive charge of the cartridges are ignited. The cartridge shell and projectile were blown apart and thrown up to 100 meters as a result of the pressure buildup in the propulsion chamber, so that the energy released when many such cartridges catch fire is considerable.

SUMMARY OF THE INVENTION

It is the object of the invention to present measures intended to prevent separation of the cartridge shell from the projectile when there is a sharp increase in ambient temperature above the ignition temperature of the pyrotechnic igniter charge.

Another object of the invention is to present measures intended to prevent damage to the environment caused by a collection of many such cartridges, e.g., in a storage or transport container, upon sharp increase in ambient temperature such as caused by a fire.

Another object of the invention is to weaken the effect of the main charge after ignition of the igniter charge so that neither large pressure damage nor major mechanical damage results.

Yet another object of the invention is to so configure the cartridge munition that the characteristics of the cartridge munition are not influenced by these preventive measures.

According to the invention, it is recommended that a cartridge munition consisting of a projectile and a cartridge shell, possessing a propulsion chamber to provide passages that exit from the propulsion chamber and penetrate the wall of the cartridge shell, to be filled with a solid, pressure-tight fusible filler material whose melting point is lower than the minimum ignition temperature of any pyrotechnic charge in the munition, i.e., lower than the ignition temperature of the pyrotechnic igniter charge and the propulsive charge.

Such a fusible material is preferably a fusible metal. Such fusible metals include alloys of bismuth and tin, whereby other metals such as lead etc. may be included.

If a cartridge of the type under discussion is heated to the melting temperature of the fusible material or metal, for example, 180° C., then the fusible material in the passages within the cartridge shell that connect the propulsion chamber to the outside melts. If the temperature continues to increase and the igniter cap and thereby the propulsive charge are ignited, then no pressure may build up within the propulsion chamber because the freed passages function as pressure-relief apertures. The result is that propulsive charge merely burns, whereby the propulsive gases thus created may escape via the pressure-relief apertures. Cartridge shells and projectiles are thus not separated from each other, so that neither pressure damage nor mechanical damage may occur.

This was confirmed by a test in which a large quantity of such cartridges was placed into a conventional transport box made of lead. The lead box was not damaged even once.

The passages between the propulsive charge and the outside of the cartridge shell may be configured in many different ways: e.g., the housing of the igniter cap may be made of such a fusible material or metal; also, pressure-relief apertures around the igniter cap that are filled with the fusible material are a possibility. Either two or four apertures are recommended for this embodiment. Another option is to provide apertures from the propulsion chamber penetrating the sidewall of the cartridge shell.

However configured, the passages must be so shaped that during a normal shot of the projectile out of the cartridge shell, the fusible material withstands the high pressures within the propulsion chamber. Resistance to pressure may be increased by configuring the passages to be conical, decreasing toward the outside, as stepped or threaded holes, etc.

For a full understanding of the present invention, reference should now be made to the following detailed description of the preferred embodiments of the invention as illustrated in the accompanying drawings.

DETAILED DESCRIPTION OF PREFERRED EMBODIMENTS

Figure 1:
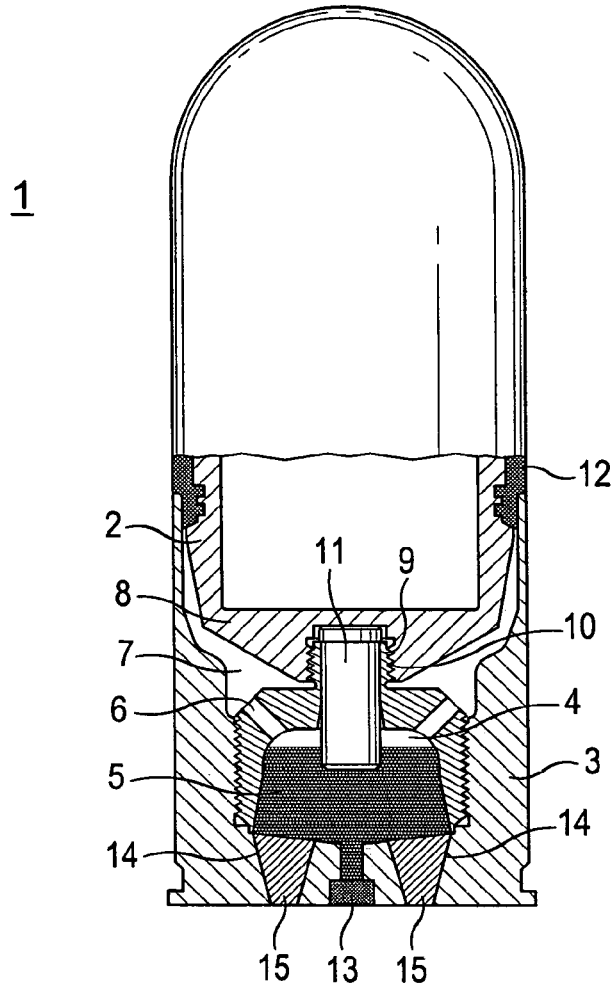
FIG. 1 is a longitudinal section through a cartridge munition consisting of a projectile and a cartridge shell that incorporates a propulsion chamber with a propulsive charge whereby, according to the invention, pressure-relief apertures are provided between the propulsion chamber and the outer wall of the cartridge shell that receive a fusible metal, and in this case possess a conical progression.

The preferred embodiments of the present invention will now be described with reference to FIGS. 1-4 of the drawings. Identical elements in the various figures are designated with the same reference numerals.

A cartridge munition 1 shown in FIG. 1 consists of a projectile 2 and a cartridge shell 3. The cartridge shell 3 includes a propulsion chamber 4 in which a propulsive charge 5 is positioned.

The wall of the propulsion chamber 4 is provided with overflow openings 6 that feed into a low-pressure chamber 7 positioned below the projectile base 8. The propulsion chamber 4 is provided with a central threaded stud 9 that engages in an inner thread in the projectile base. In addition, a tracer composition 11 is connected with the projectile base 8 that extends through the threaded stud 9 into the propulsion chamber.

The cartridge 1 possesses a caliber of from 40 mm, for example, and is fired from a tube weapon (not shown) with a twist, for which purpose the projectile possesses a guide- or twist-band (indicated only).

The propulsive charge 5 is ignited pyrotechnically by means of an igniter cap 13 whereby the igniter cap 13 is mounted in the center of the base of the cartridge shell 3.

Passages are provided between the propulsion chamber 4 and the lower base of the cartridge shell 3, in this case conical channels 14 that decrease in size as approach the base of the cartridge shell. The channels 14 possess a diameter of 7 mm for a 40 mm-caliber projectile, for example, and narrow down to about 6 mm.

For example, two or three or four channels 14 are provided, symmetrical to the central line of the projectile and to the igniter cap, that are positioned around the igniter cap.

The passages 14 are filled with a fusible metal 15. This fusible metal is, for example, a bismuth/tin alloy with 30 to 40% bismuth by weight and 60 to 70% tin by weight. Depending on the blend, the melting point of this alloy lies between about 140 and 175° C. The alloy is impact-resistant and not soluble in water.

The fusible metal 15 is cast into the channels 14 after appropriate heating, or conical rivets are made of the fusible metal that are then driven or screwed into the channels 14.

The propulsion chamber is tight and pressure-resistant toward the exterior by means of the fusible metal 15 so that the cartridge 1 may be fired from a tube weapon in the same way as a conventional cartridge. The conical shape of the channels prevents the fusible metal 15 from being forced from the channels 14 by the high pressure in the propulsion chamber.

As mentioned above, when the ambient temperature near the cartridges rises to 140 to 175° C. as the result of a fire, for example, then the fusible material 15 within the channels 14 melts, freeing them. When the temperature of the igniter cap 13 then continues to rise to above about 220° C., it ignites, also igniting the propulsive charge 5. The propulsive gases, created when the propulsive charge burns, may be diverted without consequence through the free channels 14, so that no pressure may build up within the propulsion chamber, and therefore the propulsive charge 5 is also not triggered. Cartridge shell 3 and projectile 2 further remain mechanically connected via the threads 9 and 10 so that no major damage can occur, neither because of high pressure nor because of separation of the cartridge shell and the projectile.

Figure 2:
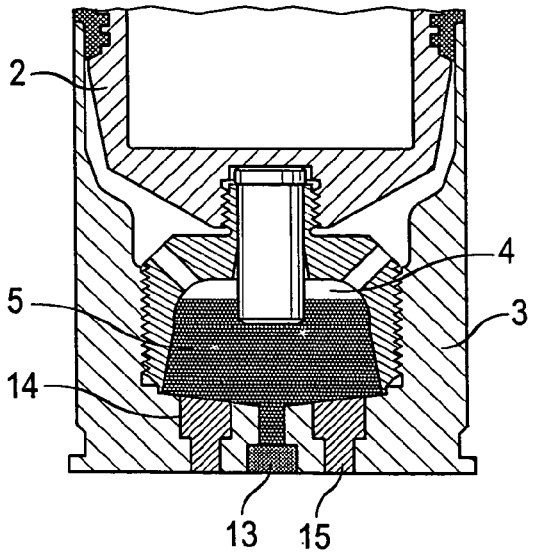
FIG. 2 is a second embodiment of a cartridge munition with stepped pressure-relief apertures between the propulsion chamber and the outer wall of the cartridge shell.

FIG. 2 shows a longitudinal section through a cartridge shell 3 and a portion of the projectile 2; cartridge shell and projectile are constructed the same as in FIG. 1 up to the channels 14 with the fusible metal 15. In this case, the channels are stepped drillings into which the fusible metal 15 is cast. Here also, the fusible metal may either be cast at the time of cartridge manufacture or threaded in, if the channels and the fusible metal are provided with threads.

Also in this embodiment, the pressure-relief channels 14, as shown, are positioned either on both sides of the central igniter cap 13 or in any other configuration around the igniter cap.

This cartridge may also be fired in the same way as a conventional cartridge. In case of fire or similar problem, the function is the same as described by FIG. 1.

Figure 3:
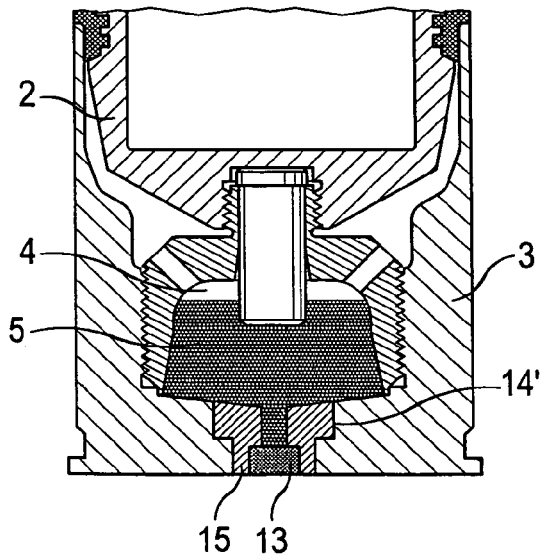
FIG. 3 is a third embodiment according to the invention whereby the housing of an igniter cap for the propulsive charge is made of a fusible metal.

FIG. 3 shows another version of a cartridge whereby only the cartridge shell 3 and a portion of the projectile 2 are shown, as in FIG. 2. The cartridge shell 3 is constructed the same way in the area of the propulsion chamber as in the embodiments shown in FIGS. 1 and 2.

In this case, the igniter cap 13 is inserted into an igniter-cap housing 14' that may be threaded into the base of the cartridge shell 3 in a charge opening 14. The igniter-cap housing 14' consists of the aforementioned fusible metal 15.

If during a fire, for example, the ambient temperature increases above the melting point of the fusible metal 15, then the igniter-cap housing 14' melts and frees a pressure-relief channel corresponding to the charge opening 14 between the base of the propulsion chamber and the base of the cartridge shell. If the igniter cap then ignites because of increasing temperature, thereby igniting the propulsive charge 5, then it merely burns out without pressure being allowed to increase, so that the cartridge shell and projectile are not separated. Pressure damage and major mechanical damage are prevented.

With the present invention, even if the pressure-relief channels 14 extend from the base of the propulsion chamber to the outer base of the cartridge shell, it is routine for the specialist to configure these channels otherwise, e.g., routing them through the sidewall of the cartridge shell and the propulsion chamber.

Figure 4:
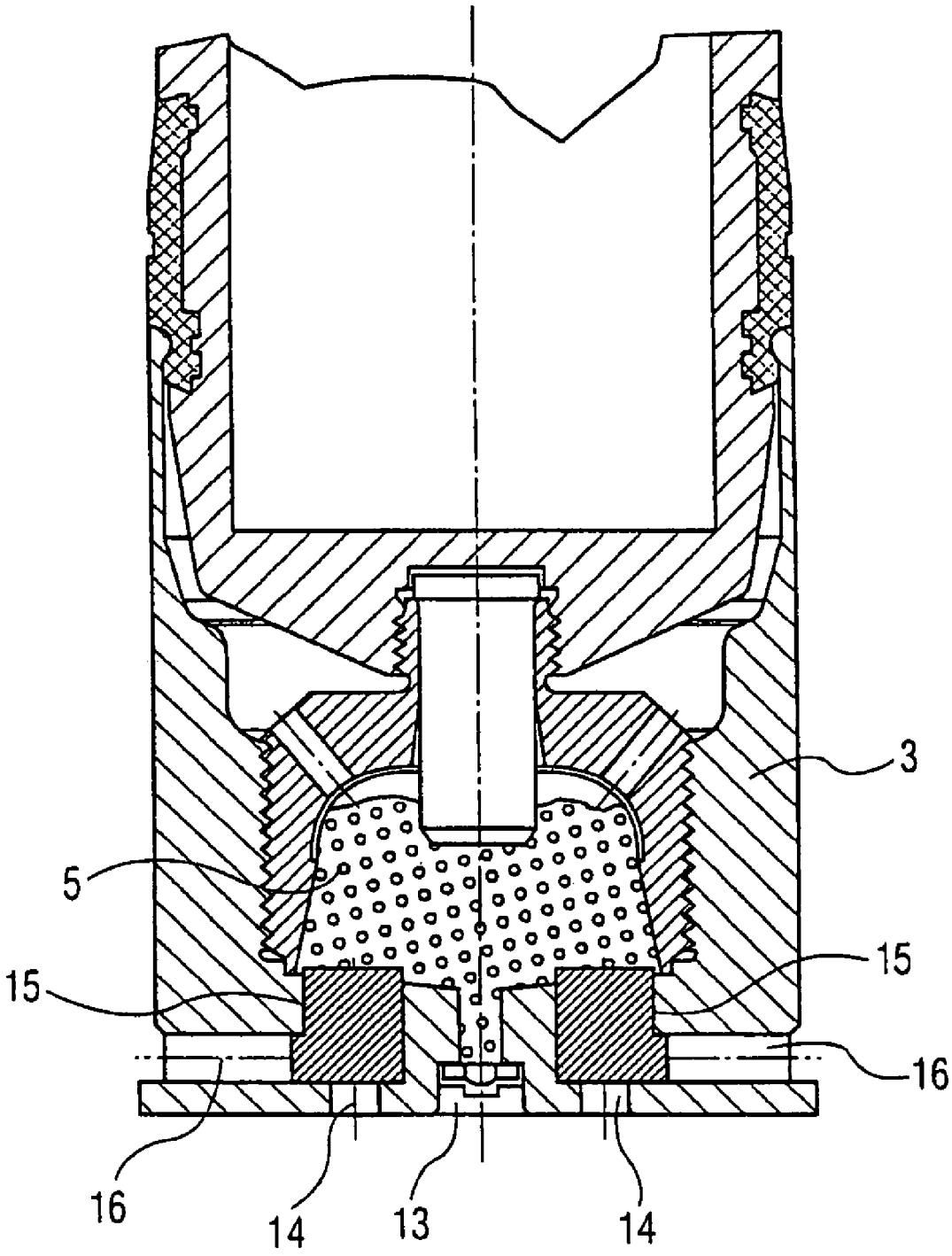
FIG. 4 is a fourth embodiment according to the invention which incorporates both axial and radial pressure-relief apertures.

FIG. 4 shows an embodiment which incorporates this feature.

As may be seen in FIG. 4, the cartridge shell 3 is provided with axial passages 14 and radial passages 16, both of which are normally blocked by fusible metal 15.

It is also possible, of course, to use other low-melting-point materials instead of the bismuth/tin alloy mentioned as long as it is strong enough to seal the pressure-relief channels completely so that a normal shot is possible from a tube weapon.

There has thus been shown and described a novel cartridge munition, particularly one of medium caliber which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. Cartridge munition with a cartridge shell and a projectile inserted into the cartridge shell and mechanically connected to it, whereby a pyrotechnic propulsive charge is located in a propulsion chamber of the cartridge shell that is ignited by means of a pyrotechnic igniter and whose propulsive gases exert a force on the base of the projectile when they burn, by means of which the projectile is driven out of the cartridge shell, the improvement wherein at least one passage exits from the propulsion chamber through the cartridge shell, said passage being filled with a fusible, solid, pressure-tight material whose melting temperature is lower than the ignition temperatures of the pyrotechnic igniter and the propulsive charge of the projectile.

2. Cartridge munition as in claim 1, wherein the pyrotechnic igniter includes a housing of fusible material that is inserted into the base of the cartridge shell and that extends into the propulsion chamber.

3. Cartridge munition as in claim 2, wherein the fusible material is a fusible metal.

4. Cartridge munition as in claim 3, wherein the fusible metal is a bismuth/tin alloy with 30 to 40% bismuth by weight and 60 to 70 tin by weight, this alloy having a melting point between 140 and 175° C.

5. Cartridge munition as in claim 1, wherein one of said at least one passage surrounds the pyrotechnic igniter as ring channel.

6. Cartridge munition as in claim 1, wherein one of said at least one passage exits from the propulsion chamber through the sidewall of the cartridge shell.

* * * * *